United States Patent [19]

Blackie et al.

[11] 4,418,026

[45] Nov. 29, 1983

[54] PROCESS FOR SPINNING CELLULOSE ESTER FIBRES

[75] Inventors: Merrick S. Blackie, West Haddon; John R. Collins, Leamington Spa, both of England

[73] Assignee: Courtaulds Limited, London, England

[21] Appl. No.: 260,914

[22] Filed: May 6, 1981

[51] Int. Cl.[3] ..... B29C 6/00

[52] U.S. Cl. ..... 264/8; 264/12; 264/207

[58] Field of Search ..... 536/76, 69; 106/178–181, 196; 264/200, 8, 12, 207

[56] References Cited

U.S. PATENT DOCUMENTS

| | | | |
|---|---|---|---|
| 1,357,206 | 10/1920 | Fuller | 264/8 |
| 1,838,121 | 12/1931 | Vles | 264/207 |
| 1,954,324 | 4/1934 | Lilienfeld | 264/207 |
| 2,341,586 | 2/1944 | Alles | 264/200 |
| 2,768,870 | 10/1956 | Drisch et al. | 264/200 |
| 2,775,529 | 12/1956 | Bates et al. | 264/200 |
| 3,003,846 | 10/1961 | Groombridge et al. | 264/200 |
| 3,428,468 | 2/1969 | Blake | 264/170 |
| 3,592,671 | 7/1971 | Malar | 106/196 |
| 3,846,403 | 11/1974 | Gibney et al. | 536/69 |
| 3,870,703 | 3/1975 | Gibney et al. | 536/69 |
| 4,049,695 | 6/1978 | Sanders | 106/178 |
| 4,228,276 | 10/1980 | Kuo | 536/76 |

FOREIGN PATENT DOCUMENTS

| | | | |
|---|---|---|---|
| 48-17485 | 5/1973 | Japan . | |
| 1107861 | 2/1965 | United Kingdom . | |
| 521364 | 10/1976 | U.S.S.R. | 264/207 |

*Primary Examiner*—Jay H. Woo

*Attorney, Agent, or Firm*—Howson and Howson

[57] ABSTRACT

Cellulose ester fibres are dry-spun from a solution in an aliphatic carboxylic acid, which solution may comprise the product liquor of the carboxylation reaction used to form the cellulose ester. Spinnability is achieved by incorporating an organic fibre-forming carrier polymer such as poly(ethylene oxide) in the spinning dope. The process may be used to spin cellulose acetate fibres and is economical in avoiding the use of conventional acetate solvents and the various purification stages usually required after the acetate is formed by acetylation. Blow-spinning or centrifugal spinning may be used to spin fine fibres.

7 Claims, No Drawings

PROCESS FOR SPINNING CELLULOSE ESTER FIBRES

This invention relates to a process for spinning cellulose ester fibers, particularly the commercially predominant cellulose acetate fibres.

Cellulose acetate is manufactured by the acetylation of a cellulosic feedstock such as wood pulp or cotton linters by acetic anhydride and acetic acid, usually in the presence of a small proportion of sulphuric acid. The primary product of this reaction is cellulose triacetate. The secondary product, the diacetate, is produced by hydrolysis of the triacetate. The cellulose acetate is usually dissolved in the acetic acid reaction liquor and the normal procedure is to discharge this solution into an excess of weak acid solution to precipitate the cellulose acetate as flake. This is washed, filtered and dried before being redissolved in the appropriate solvent to form a spinning dope, usually aqueous acetone in the case of the diacetate and methylene chloride/alcohol in the case of the triacetate. The dope is dry spun to form cellulose acetate fibres.

According to this invention, a process for spinning fibres of a cellulose ester comprises making a spinning dope which comprises an aliphatic carboxylic acid solution of a cellulose ester, which solution incorporates another organic fibre-forming polymer (hereinafter called the carrier polymer) dissolved or dispersed therein for improved dope spinnability, and dry-spinning the dope to form fibres.

The term 'fibres' is used throughout this specification as a general term including continuous filaments, discontinuous filaments and staple fibres.

The carboxylic acid solution of the cellulose ester preferably comprises the product liquor from the carboxylation reaction used to prepare the ester. Thus, cellulose acetate is in general used in soultion in acetic acid. The ability to spin fibres directly from this reaction liquor enables a substantial reduction in processing and raw material costs to be made, because the flake precipitation, washing and drying stages and the normal dope preparation steps are eliminated.

The necessary spinnability is imparted by the incorporation of a carrier polymer in the solution. This preferably dissolves in the solution but may be dispersed as a colloidal solution or sol. It is preferably a linear polymer which is soluble in the carboxylic acid solution. Suitable carrier polymers include polyethers derived from alkylene oxides, particularly poly(ethylene oxide) otherwise poly(ethylene) glycol), poly(vinyl alcohol) and partially-hydrolysed poly(vinyl acetate), poly(acrylic acids), polyacrylamides and partially-hydrolysed polyacrylamides, cellulose ethers, soluble gums and starches, alginic acids, poly(vinyl pyrrolidones) and polyurethanes.

It is prudent to use as little of the carrier polymer as is required to give the desired spinnability unless more is required for the purpose of modifying the characteristics of the spun fibre in terms, for example, of dyeability, handle or moisture regain. In general, concentrations in the dope of 5 per cent by weight or less are sufficient to achieve optimum spinnability. For example with poly(ethylene oxide) of molecular weight in the range 100,000 to 1,000,000 (preferably 300,000 to 600,000), a concentration in the dope of about 0.5 per cent by weight gives good spinnability.

In the case of an acetic acid solution of cellulose acetate, suitable spinning viscosities can be obtained using concentrations of cellulose acetate in the dope in the range 15 to 25 per cent by weight and product liquors from the carboxylation reaction having such ester concentrations may be used. If desired, however, for example if the viscosity of the liquor produced directly after reaction would produce too great a spinning viscosity after adding of the carrier polymer, the liquor may be diluted with additional acetic acid and/or with methylene chloride, e.g. to a cellulose acetate concentration as low as 5 to 7 per cent by weight.

The dry-spinning process used may comprise the conventional one of extruding the spinning solution through a spinning jet into a heated gaseous atmosphere. A normal cross-draught cabinet may be used. Alternatively, the technique known as blow spinning may be used in which gaseous jets are directed at the fibres as they emerge from the jet holes. These gaseous jets have a component in the direction of extrusion so that they exert a drawing action on the fibres thereby attenuating the fibers to very fine diameters as low as 0.05 d.tex per fibre or even lower. In addition they assist in driving off the carboxylic acid solvent. Centrifugal spinning is another known dry-spinning technique which may be used.

When a conventional dry-spinning technique is used the gaseous atmosphere into which the fibres are directed may be heated to a temperature at which the carboxylic acid solvent in the fibres is flashed off and this temperature is higher than that used with the conventional solvent dopes. In the case of acetic acid, air at a temperature of 140° to 150° C. or even higher is required in such conventional techniques for adequate removal of the acetic acid from the fibres. When using blow spinning and centrifugal spinning lower air temperatures may be employed because the air flow helps to drive off the carboxylic acid.

The spinning solution is pre-heated, preferably to a temperature at which the carboxylic acid can readily be flashed off during spinning.

The invention is illustrated by the following Examples in which the percentages given are by weight.

EXAMPLE 1

A solution of cellulose acetate in the acetylation liquor used in its manufacture comprised 17.3 percent cellulose acetate, 71 percent glacial acetic acid, 10 percent water and 1.7 percent acetylation by-products.

Poly(ethylene oxide) of molecular weight 600,000 was blended into this solution in an amount providing a concentration of 0.5 percent based on the spinning dope produced. This dope had a viscosity of 600 poises as measured by the ball-fall method.

The spinning dope was filtered and then pumped under pressure through a candle-filter unit and a heater to a conventional cellulose acetate spinning jet assembly. The jet was a 5 hole jet with holes of 90 microns diameter. The dope, which had been pre-heated to a temperature of 90° C., was extruded at 250 meters/min. into a conventional dry spinning cabinet in which the air was at a temperature of 150° C.

The spun filaments were drawn down by a factor of 2.0 and collected as a yarn on a side-wound package. The yarn was of 245 d.tex.

EXAMPLE 2

A spinning dope was made by mixing some of the solution of cellulose acetate in acetylation liquor used in Example 1 with glacial acetic acid and a solution of poly(ethylene oxide) of molecular weight 600,000 in glacial acetic acid. The dope had the following composition:

| | |
|---|---|
| Cellulose acetate solution of Example 1 | 44.6 gms |
| Glacial acetic acid | 38.4 gms |
| A 2 percent solution of poly(ethylene oxide) in glacial acetic acid | 25.0 gms |

The dope produced had a cellulose acetate concentration of about 7 percent and a poly(ethylene oxide) concentration of about 0.5 percent. Its viscosity was 51 poises as measured by the ball-fall method.

The spinning dope was filtered and pre-heated as in Example 1, but instead of being pumped to a spinning jet it was gravity fed to a blow-spinning nozzle. This was a standard spray jet nozzle made by the Spraying Systems Company Ltd. from which the cap, onto which the liquid and air streams are directed, had been removed. The resulting nozzle was essentially a simple jet hole of diameter 400 microns flanked by two air passages from which air streams issued at room temperature to intersect the extruded filament just below the nozzle. These air streams had the effect of drawing the filament away from the jet so as to attenuate it whilst at the same time assisting in driving off the acetic acid solvent.

The dope extrusion rate was 0.3 gms/hr and the speed of the issuing air streams was 17 meters/sec. The attenuated filament was collected on a slowly rotating roller covered with a wire mesh where it distributed itself over the roller surface to form a non-woven web. The surface speed of the roller was 30 cms/minute and it was positioned 75 cms away from the spinning nozzle.

The collected filament was extremely fine with a diameter of about 2 microns. The draw ratio was in the region of $1\times10^6$:1.

What is claimed is:

1. A process for spinning fibers of a cellulose ester which comprises using as the spinning dope the product liquor from the carboxylation reaction used to prepare the cellulose ester, adding to said dope not more than about 5 percent, by weight, of another fiber-forming polymer which is soluble or dispersible in said dope to improve the spinnability of said dope, and dry spinning said dope to form fibers.

2. A process as claimed in claim 1 in which the cellulose ester is cellulose acetate and the carboxylic acid is acetic acid.

3. A process as claimed in claim 2 in which the concentration of cellulose acetate in the product liquor is in the range from 15 to 25 percent by weight.

4. A process as claimed in claim 1 in which the other organic polymer is a linear polymer which is soluble in the carboxylic acid solution.

5. A process as claimed in claim 4 in which the linear polymer is poly(ethylene oxide).

6. A process as claimed in claim 1 in which the dope is dry-spun by a blow-spinning process.

7. A process as claimed in claim 1 in which the dope is dry-spun by a centrifugal spinning process.

* * * * *

UNITED STATES PATENT AND TRADEMARK OFFICE

CERTIFICATE OF CORRECTION

PATENT NO. : 4,418,026
DATED : November 29, 1983
INVENTOR(S) : Merrick S. Blackie and John R. Collins It is certified that error appears in the above-identified patent and that said Letters Patent are hereby corrected as shown below:

The following information is to be added to the title page:

[30] Foreign Application Priority Date
May 12, 1980 [GB] United Kingdom 8015636

Signed and Sealed this

*Thirtieth* Day of *April 1985*

[SEAL]

*Attest:*

DONALD J. QUIGG

*Attesting Officer* *Acting Commissioner of Patents and Trademarks*